US005577598A

United States Patent [19]

Schoenenberger

[11] Patent Number: 5,577,598

[45] Date of Patent: Nov. 26, 1996

[54] APPARATUS FOR CONTROLLING THE CONVEYOR SPEED OF MOVING CONVEYOR MEANS

[75] Inventor: Willi Schoenenberger, Schoenenberg, Switzerland

[73] Assignee: Woodway AG, Schoenenberg, Sweden

[21] Appl. No.: 531,208

[22] Filed: Sep. 19, 1995

[30] Foreign Application Priority Data

Sep. 20, 1994 [DE] Germany ..... 9415266 U

[51] Int. Cl.[6] ..... B65G 23/04

[52] U.S. Cl. ..... 198/832.2; 482/54

[58] Field of Search ..... 198/832.2, 835, 198/861.5; 193/35 A; 482/54

[56] References Cited

U.S. PATENT DOCUMENTS

| | | | |
|---|---|---|---|
| 1,743,995 | 1/1930 | Bartlett | 198/832.2 X |
| 2,813,604 | 11/1957 | Koepnick et al. | 198/832.2 X |
| 4,635,928 | 1/1987 | Ogden et al. | 482/54 |
| 5,431,612 | 7/1995 | Holden | 482/54 |

FOREIGN PATENT DOCUMENTS

| | | | |
|---|---|---|---|
| 2503118 | 4/1976 | Germany | A63B 23/06 |
| 0610746 | 6/1978 | U.S.S.R. | 198/832.2 |
| 2152825 | 8/1985 | United Kingdom | A63B 23/06 |

*Primary Examiner*—James R. Bidwell
*Attorney, Agent, or Firm*—Seed and Berry LLP

[57] ABSTRACT

In moving conveyors or treadmills with variable inclination, there is provided an apparatus for controlling the conveyor speeds, which apparatus comprises a brake band with the aid of which the circumference of a friction disk fixed for rotation with a driven shaft can be acted upon. With the aid of the control apparatus the moving conveyor is the more strongly braked the higher the inclination is that has been chosen for the moving conveyor so as to guarantee that the predetermined conveyor speed is always observed during operation.

6 Claims, 1 Drawing Sheet

APPARATUS FOR CONTROLLING THE CONVEYOR SPEED OF MOVING CONVEYOR MEANS

TECHNICAL FIELD

The present invention relates to an apparatus for controlling the conveyor speed of an endless moving conveyor guided over at least one driven shaft, in particular a lamellar moving conveyor, with variable gradient setting.

BACKGROUND OF THE INVENTION

German patent application 25 03 118 discloses a moving conveyor or treadmill means according to the WOODWAY system whose endless driven moving conveyor consists of two endless belts that are in parallel with each other and are connected by means of a plurality of tread lamellae which extend in a direction transverse to the running direction. Deflection pulleys around which the endless moving conveyor is guided are seated in the known moving conveyor means at the ends of two shafts arranged one after the other in spaced-apart relationship.

Such lamellar moving conveyors comprise support rollers, in particular ball-bearing support rollers, below the upper side of the moving conveyor.

Moving conveyor means with an even conveyor surface i.e. without gradient (inclination), are used virtually exclusively in rehabilitation centers. By contrast, fitness centers preferably employ moving conveyor means in which the gradient (inclination) of the moving conveyor can be adjusted in any desired manner. To this end the front end of the moving conveyor is lifted whilst the rear conveyor end remains in its original position. As a result of such a height adjustment, the user of such a moving conveyor must run "uphill".

It is important for all moving conveyors because of the safety of the user (hereinafter called "runner"), and in order to guarantee the training success aimed at, that the adjustable conveyor speeds which are carefully predetermined as a rule and preset via control units be observed.

At gradients of about 2% and more, problems arise with respect to the control of the respectively predetermined conveyor speeds, especially in lamellar moving conveyors that are lower in friction than more conventional moving conveyors.

As is generally known a moving conveyor is driven as to its direction in such a manner that the running direction of a runner is opposite to the direction of movement of the upper conveyor side acted upon by the runner.

At gradients of about 2% and more, the introduction of forces into the moving conveyor, which forces are created by the runner pushing his feet off from the moving conveyor, accelerates the conveyor movement, since the push-off forces exerted on the moving conveyor create movement pulses that act in the direction of the conveyor drive. As a consequence, said push-off forces add up to the drive force exerted by the drive means (electric motor) on the moving conveyor, with the effect that the moving conveyor moves faster than intended. Such accelerations of the conveyor movement is a risk potential for runners.

To avoid such an undesired effect, so-called 4-quadrant control units are used for keeping the predetermined conveyor speed constant, the control units controlling the conveyor speed both in the forward direction and the rearward direction with the aid of electric/electronic measuring and control circuits. At gradients of about 2% and more, the moving conveyor must be braked more and more for this purpose so as to guarantee that the predetermined conveyor speed is maintained without the conveyor speed being influenced by the runner.

Such an electric/electronic 4-quadrant control is rather troublesome and considerably increases the production costs of a moving conveyor means with inclination adjustment.

SUMMARY OF THE INVENTION

It is therefore the object of the present invention to provide an apparatus for controlling the conveyor speed of moving conveyor means preamble, said apparatus guaranteeing in an inexpensive manner that the moving conveyor moves in a controlled manner at all inclinations (gradients). In other words, the invention is to ensure that the moving conveyor does not rotate faster than intended when used by a runner at gradients (inclinations) of more than about 2%.

The technical progress which can be achieved with the present invention must primarily be seen in the creation of a means which is very efficient despite its low costs and is used for controlling the conveyor speed, namely with the aid of the friction band which acts on the driven shaft and whose contact force (braking force) depends on the respectively selected conveyor inclination.

BRIEF DESCRIPTION OF THE DRAWINGS

The present invention shall now be described in more detail with reference to an embodiment taken in conjunction with the drawing, in which.

DETAILED DESCRIPTION OF THE INVENTION

Figure 1:
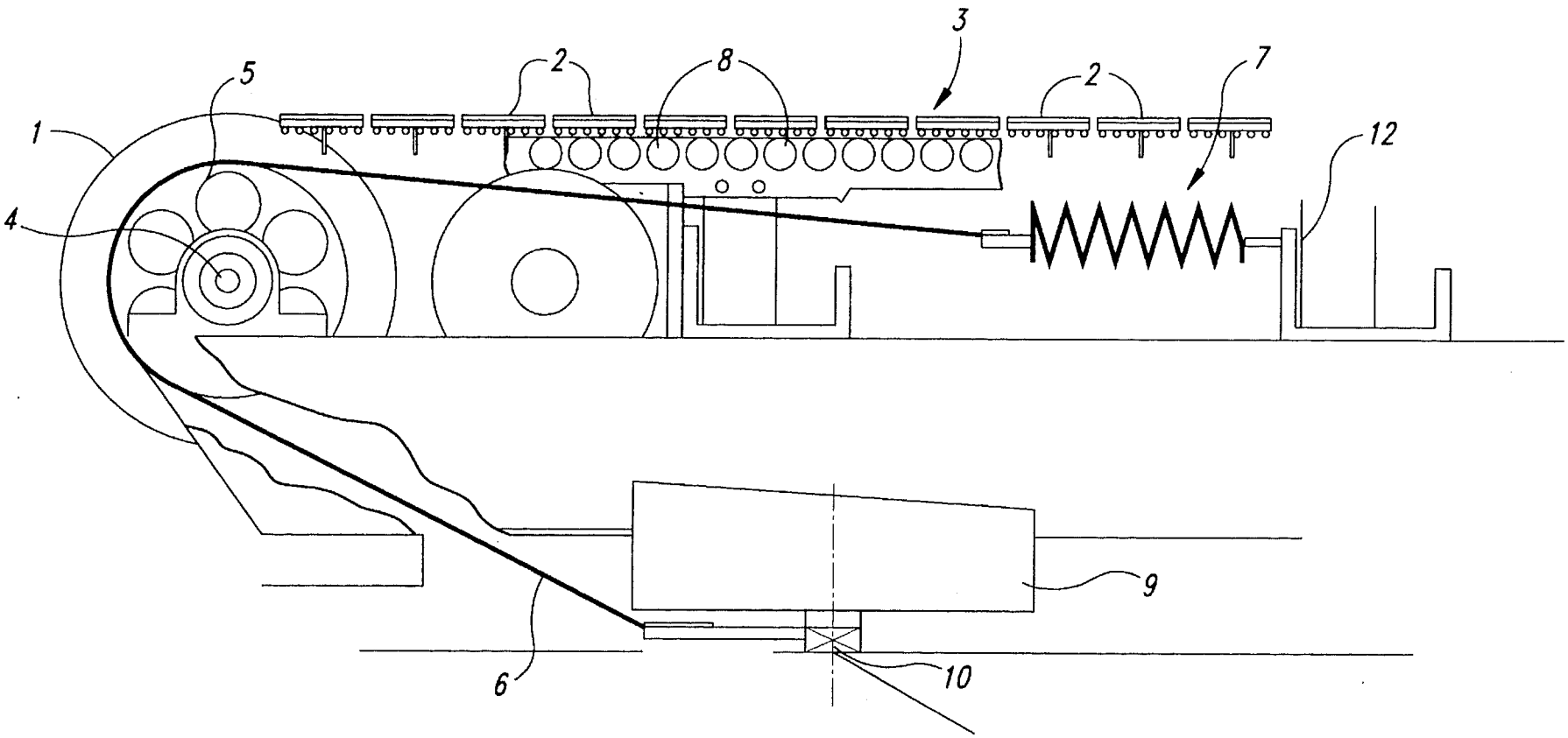
FIG. 1 is a diagrammatic detail representation of the front end of the moving conveyor means (view).

Though not shown in the drawing, an electric motor with the aid of which a shaft 4 can be driven via a driving belt is provided in the area of the front end of the moving conveyor means. At its ends, the driven shaft 4 respectively comprises deflection pulleys 1 in pairs via which a lamellar moving conveyor 3 is guided. The drawing just shows a front deflection pulley 1. Such a lamellar moving conveyor normally comprises two belts which are spaced apart in parallel with each other and which have secured thereto a plurality of tread lamellae 2 in a direction transverse to the direction of movement of said belts.

A plurality of preferably ball-bearing support rollers 8 that stabilize the surface of the tread lamellae and prevent the lamella surfaces from being pressed downwards to an excessive degree during use are provided below the upper side of the moving conveyor 3.

When the lamellar moving conveyor 3 is started with the aid of the electric motor, the upper side of the moving conveyor which is supported on the support rollers 8 moves from the left to the right side when FIG. 1 is looked at, whereas a runner (not shown) follows a running direction opposite to the direction of movement of the conveyor.

To move the conveyor surface of the upper side from a horizontal orientation into an inclined orientation, a gradient adjusting means is provided, which is designated schematically by reference numeral 9. The gradient adjusting means 9 serves the purpose to lift the front end of the moving conveyor means as illustrated in the drawing from a horizontal initial position, to fix it in different height positions and to return it into the initial position in case of need. For instance, when a gradient of 5% is chosen, this means that the front end of the moving conveyor means as illustrated in the drawing is lifted accordingly whilst the rear end (not shown) which is opposite to said front end is supported at a correspondingly lower level, so that the conveyor extends upwardly in an oblique plane in front of the runner. Within the scope of this description "front end" means that end of the moving conveyor means in the direction of which a runner runs and looks.

When a runner moves on the upper side of the conveyor in such an inclined operative position, he gives movement pulses to the upper conveyor side when pushing off his feet therefrom, the movement pulses increasing the speed of the moving conveyor as said movement pulses act in the same sense as the drive imparted by the electric motor.

To eliminate the undesired drive pulses created by the runner, there is provided a speed controlling means 5, 6, 7 which is composed as follows:

A friction disk 5 is seated on the driven shaft 4 for rotation therewith. The circumference of the friction disk 5 is acted upon over a sufficiently large area by a brake band 6 whose first end is secured to a vertically adjustable component 12. "Vertically adjustable component" means a component of the moving conveyor means that changes its local position during height adjustment. When the front end of the moving conveyor means as shown in the drawing is lifted, the so-called vertically adjustable component is simultaneously lifted. When the moving conveyor end in question is lowered, the so-called vertically adjustable component is also lowered.

The second end of the brake band 6 is connected to a stationary component 10 which is not vertically adjustable. A bottom plate of the gradient adjusting means 9 preferably serves as a stationary component 10. The above-mentioned first end of the brake band 6 is preferably not directly connected to the vertically adjustable component 12, but via an adjustable spring means 7 which is secured with its one end to the so-called first end of the brake band 6 and with its other end to the vertically adjustable component 12. With the aid of the interposed adjustable spring means 7, the friction means which substantially consists of the friction disk 5 and the brake band exhibits dynamic characteristics. Instead of spring 7, other known means that make the braking operation "dynamic" may be provided.

The friction means is adjusted such that brake band 6 does not exert any braking effect on the friction disk 5 as long as the gradient (inclination) of the moving conveyor is less than about 2%. However, if a gradient of the moving conveyor of more than 2% is set with the aid of the gradient adjusting means 9, the brake band 6 will exert a slight braking effect on the friction disk 5 and thus on the driven shaft 4 of the moving conveyor 3. The more the gradient adjusting means 9 is extended, i.e., the greater the gradient (inclination) of the moving conveyor is, the stronger is the braking force exerted by the brake band on the circumference of the friction disk 5.

At great gradients of the brake band the moving conveyor is no longer driven by the motor means 1, but is just braked with the aid of friction disk 5 and brake band 6.

The above-mentioned increase in the braking performance as a function of increasing gradients of the brake band is due to the fact that brake band 6 exerts an increasingly stronger braking pressure on the circumference of the friction disk 5 when the brake band secured to the vertically adjustable component 12 is moved upwards from its position occupied at zero gradient. At a zero gradient the brake band 6 is slack. The greater the gradient (inclination), the more intensively is the brake band tensed as a consequence of the upwardly moved fastening point of the brake band and of the spring on the vertically adjustable member. This, in turn, leads to a correspondingly higher braking pressure on the circumference of friction disk 5.

I claim:

1. An apparatus for controlling the conveyor speed of an endless moving conveyor guided over at least one driven shaft, in particular a lamellar moving conveyor, with variable inclination adjustment, characterized in that there is provided a brake band which acts on the driven shaft and whose braking effect can be increased with an increasing gradient of the moving conveyor.

2. The apparatus of claim 1, characterized in that a friction disk whose circumference can be acted upon by said brake band is provided for rotation with said driven shaft.

3. The apparatus of claim 2, characterized in that said brake band is secured with its first end to a component which is vertically adjustable during gradient adjustment, and that the second end of said brake band is secured to a stationary component which is not vertically adjustable.

4. The apparatus of claim 3, characterized in that the second end of said brake band is secured to a stationary bottom plate.

5. The apparatus of claim 4, characterized in that the first end of said brake band is secured to said vertically adjustable component with a spring being disposed thereinbetween.

6. The apparatus of any one of claims 1 to 5, characterized in that said brake band exerts an increasingly greater braking force on said friction disk with an increasing inclination of said moving conveyor.

* * * * *